United States Patent [19]

Toelke

[11] 4,423,647

[45] Jan. 3, 1984

[54] PIPE ALIGNMENT APPARATUS AND METHOD

[75] Inventor: Lester W. Toelke, Houston, Tex.

[73] Assignee: International Tool & Supply Co., Inc., Houston, Tex.

[21] Appl. No.: 232,144

[22] Filed: Feb. 6, 1981

[51] Int. Cl.[3] ..... B25B 13/50

[52] U.S. Cl. ..... 81/57.34

[58] Field of Search ..... 81/57.16, 57.2, 57.34, 81/57.35, 57.17, 57.18, 57.19; 175/85; 166/85

[56] References Cited

U.S. PATENT DOCUMENTS

| | | | |
|---|---|---|---|
| 2,450,934 | 10/1948 | Calhoun | 255/35 |
| 2,649,283 | 8/1953 | Lundeen | 81/57.19 |
| 2,950,639 | 8/1960 | Mason | 81/57.18 |
| 3,722,603 | 3/1973 | Brown | 81/57.16 |
| 3,803,953 | 4/1974 | Geczy et al. | 81/53 |
| 3,806,021 | 4/1974 | Moroz et al. | 288/4 |
| 3,828,413 | 8/1974 | Province et al. | 29/200 |
| 3,838,613 | 10/1974 | Wilms | 81/57.34 |
| 3,874,518 | 4/1975 | Swoboda, Jr. et al. | 214/1 P |
| 3,976,207 | 8/1976 | Schultz | 214/2.5 |
| 4,147,215 | 4/1979 | Hodge et al. | 81/57.16 |

*Primary Examiner*—James L. Jones, Jr.

*Attorney, Agent, or Firm*—Arnold, White & Durkee

[57] ABSTRACT

In accordance with an illustrative embodiment of the present invention, a pipe alignment tool includes upper and lower, vertically aligned clamp assemblies that can be opened and closed in order to encircle and grasp adjacent threaded end sections of well pipe to bring them into precise vertical alignment. The upper clamp assembly can be lowered toward the lower clamp assembly while the upper pipe section is rotated in order to at least partially make up the threaded connection.

9 Claims, 8 Drawing Figures

PIPE ALIGNMENT APPARATUS AND METHOD

FIELD OF THE INVENTION

This invention relates generally to pipe manipulating and alignment apparatus and particularly to a new and improved apparatus for facilitating alignment, stabbing and threading of tubular members such as drill pipe or casing during running of the same into a well.

BACKGROUND OF THE INVENTION

A long standing problem in the oil drilling industry is to properly align and then join or "make up" threaded tubular members that are being run into a well, particularly large diameter casing that is used to line the well. Standard procedure is to use the cat line and a choke loop to lift pipe joints laying in the "V" door ramp up into the interior of the derrick and then lower the male or pin end of the joint toward the upward looking female or box end of a pipe joint previously run and left hanging in the slips in the rotary table. A crew member known in oil patch parlance as a "stabber" working on a special catwalk called a "stabbing board" that is located some 30 to 35 feet above the rig floor attempts to maneuver the pipe and to judge whether it is properly aligned and ready to screw in. He may use various types of mechanical devices to pull the top of the pipe over while crew members below try to center it, all of which involves a certain amount of guesswork in addition to being somewhat hazardous duty since a joint of 20" casing may weigh about 3,000–9,000 pounds.

Thus, it is not uncommon for a pipe joint to be unknowingly cross threaded, resulting in thread damage. If left unnoticed and lowered into the well, threaded joint failure or a leak can develop. Where the joint is hydraulically tested, of course the discovery of a leak dictates that the joint be unscrewed and recoupled, resulting in lost rig time and attendant expense.

The foregoing problems are amplified when attempting to run casing into a well from a floating drilling vessel that may pitch and roll in heavy seas.

It is the general object of the present invention to provide a new and improved apparatus for aligning pipe sections to facilitate their threaded engagement in a more reliable and safe manner then is heretofore been known in the art.

SUMMARY OF THE INVENTION

This and other objects are attained in accordance with the concepts of the present invention through the provision of a pipe alignment apparatus comprising an upper clamp assembly and a lower clamp assembly that are connected to one another in axial alignment by adjustable means for controlling the amount of vertical separation of the assemblies. In a preferred embodiment, the adjustable means includes one or more hydraulically operated rams having their cylinders connected to one of the clamp assemblies and their piston rods connected to the other. Each clamp assembly includes a relatively fixed segment and a pivotally mounted segment that are hinged together, and means are provided for opening the segments to enable the lower clamp assembly to be positioned around the upper end portion of a lower pipe section, and the upper clamp assembly to be positioned around the lower end portion of an upper pipe section, whereupon the clamp assemblies are closed to encircle and grasp the respective ends of the pipe sections and thus automatically align the same for threaded engagement. The adjustable means then is operated to lower the upper pipe section toward the lower pipe section at a controlled rate of descent while the upper pipe section is rotated by suitable means in order to at least partially make up the threaded connection.

It will be recognized that the use of the present invention virtually eliminates the haphazard operations and dangerous conditions that have existed in connection with the running of casing and other tubular goods into wells in the past.

BRIEF DESCRIPTION OF THE DRAWINGS

The present invention has other features and advantages that will become more clearly apparent in connection with the following detailed description of a preferred embodiment, taken in conjunction with the appended drawings in which.

DESCRIPTION OF A PREFERRED EMBODIMENT

Figure 1:
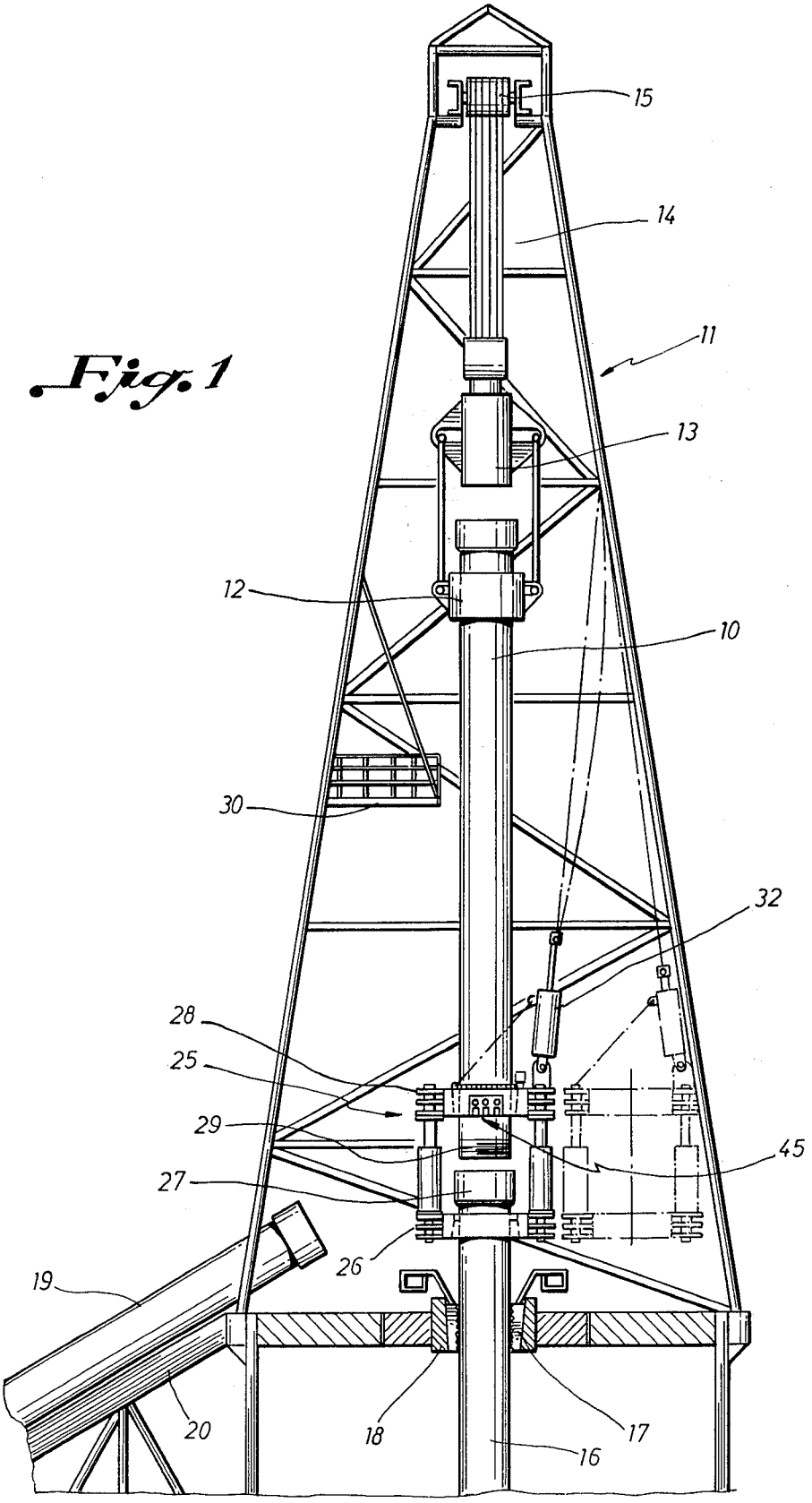
FIG. 1 is a somewhat schematic view of a drill site where tubular goods are being run into the well using the alignment apparatus of the present invention.

Referring initially to FIG. 1, a joint of well casing 10 is shown suspended within the derrick 11 of a drilling rig on elevators 12 that are hung from the traveling block 13. The traveling block 13 is suspended by cable 14 from the crown block 15, and of course the cable is led to a draw works (not shown) on the rig floor that is operated to adjust the vertical position of the elevators 12 and anything hung therefrom within the derrick. A joint of casing 16 that has already been lowered into the well is shown suspended in slips 17 that are positioned in the rotary bushing 18, and another casing joint 19 that eventually will be aligned and threaded to the upper end of the suspended joint 10 is shown resting on the "V" door ramp 20. A pipe alignment apparatus 25 that is constructed in accordance with the principles of the present invention is shown with the lower jaw assembly 26 clamped onto the upper end of the casing joint 16 below its threaded collar 27, and with the upper jaw assembly 28 thereof clamped onto the lower end portion of the suspended casing joint 10 so as to align the lower threaded or pin end 29 thereof for stabbing into the box end of the pipe joint 16 provided by the collar 27. Although the running of well casing is illustrated, other types of tubular goods such as drill pipe and tubing may be run as well.

A stabbing board 30 is attached within the derrick 11 at a considerable distance above the rig floor and provides a work station and walkway for a casing crew member called a "stabber", whose job it is to manuever the pipe joint 10 into axial alignment with the lower joint 16 so that the threaded connection can properly be made. It will be recognized that due to the distance that this station is above the rig floor and to the weight of the pipe, the stabber has rather hazardous duty and normally will attach himself to the board 30 by suitable safety devices.

The alignment tool 25 is suspended within the derrick 11 on a line that is attached to a height adjusting cylinder 32 that can be extended and retracted through use of suitable pneumatic or hydraulic controls. When the tool 25 is not in use, it can be moved to the side of the derrick 11 to an out-of-the-way position shown in dotted lines in FIG. 1 to permit the use of other tools and equipment.

Figure 2:
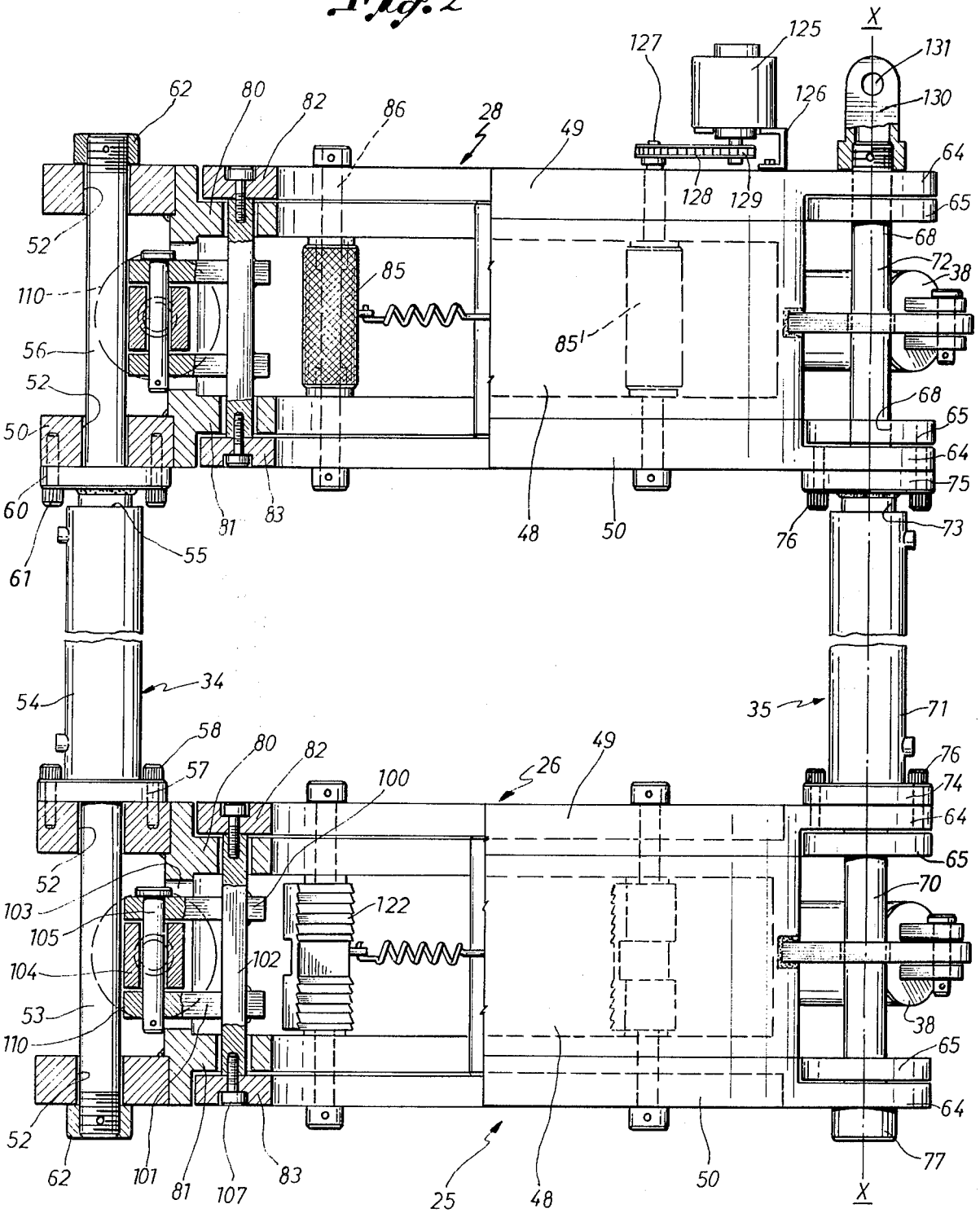
FIG. 2 is a cross-sectional view, with portions in side elevation, of a pipe alignment apparatus in accordance with the present invention.
Figure 3:
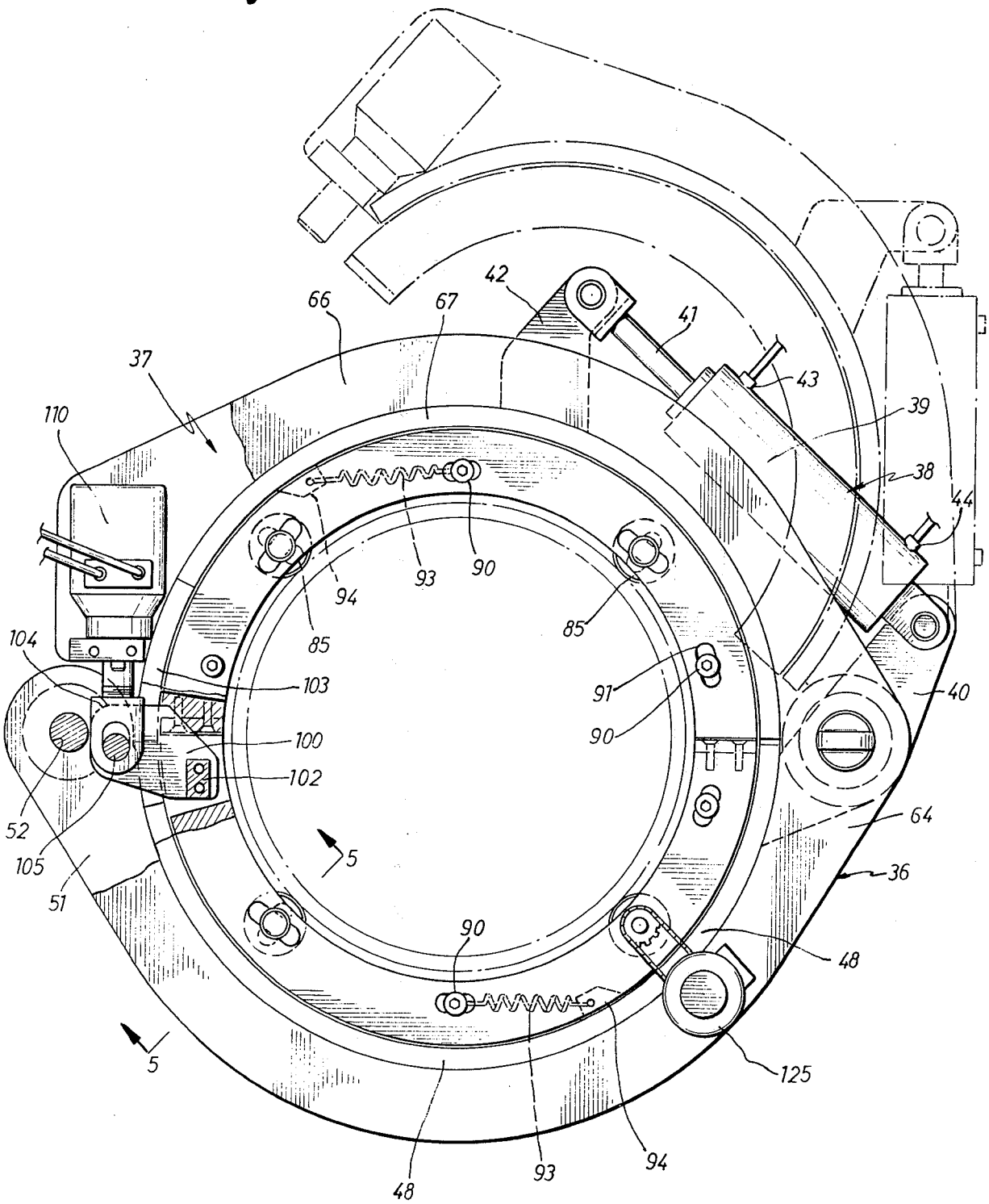
FIG. 3 is a top view of the apparatus shown in FIG. 2.
Figure 3:
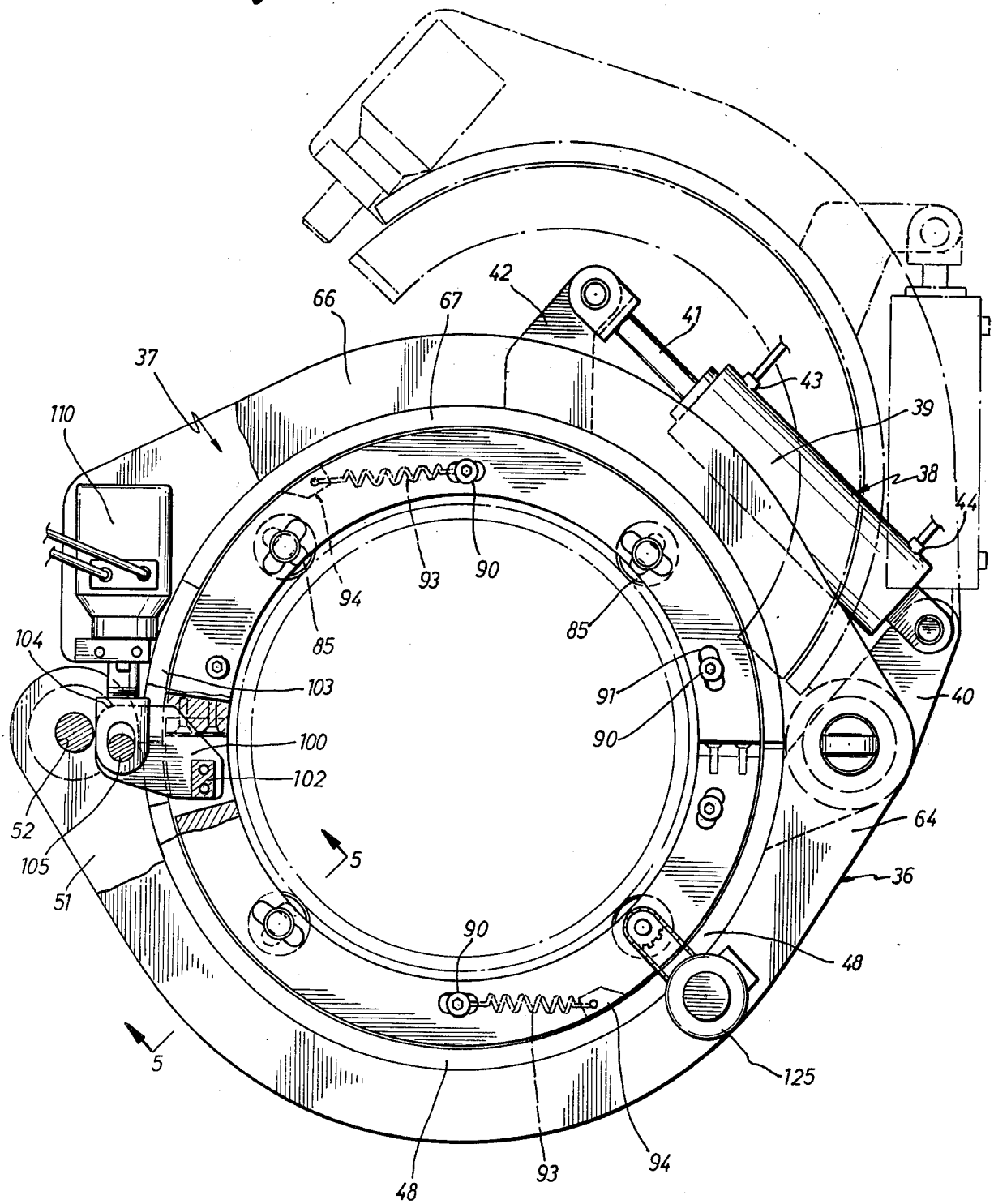

Turning now to FIGS. 2 and 3 for an illustration of the structural detail of the alignment tool 25, the assembly includes a lower clamp assembly 26 and an upper clamp assembly 28 that are coupled together by diametrically opposed hydraulic rams indicated generally at 34 and 35. The rams 34 and 35 are each double-acting devices that can be selectively extended and retracted in order to adjust the vertical separation of the clamp assemblies 26 and 28. Each of the clamp assemblies comprises a relatively fixed semi-circular segment 36 and a hinged semi-circular segment 37 with the center line of the hydraulic ram 35 defining a hinge axis X—X in a manner such that the hinged segments can be individually opened and closed with respect to their companion fixed segments. As shown in FIG. 3, the opening and closing of each hinged segment is controlled by a hydraulic ram 38 having its cylinder 39 pinned to a bracket 40 that is welded or otherwise attached to the fixed segment 36. The piston rod 41 of each ram similarly is pinned to a bracket 42 that is secured to the hinged segment 37, so that extension of the ram will cause the hinged segment to swing toward closed position, and retraction of the ram will cause the hinged segment to swing toward the open position shown in phantom lines in FIG. 3. Hydraulic lines (not shown) are connected to the respective ports 43 and 44 of the cylinder 38 so as to supply and exhaust hydraulic fluid to and from the opposite sides of the piston to effect the extension and retraction of the rod 41. The hydraulic lines extend to an operator control console 45 (FIG. 1) that is provided with a source of fluid under pressure and a typical valving arrangement the details of which will be readily understood by those skilled in the art and need not be set forth in detail herein.

Each of the fixed segments 36 of the clamp assemblies 26 and 28 includes a bowl 48 having arcuate stiffeners or ribs 49 and 50 welded to the upper and lower outer surfaces thereof. The end portion 51 of each of the ribs that is located opposite the hinge axis X—X has an aperture 52 formed therein. The apertures 52 in the ribs of the lower clamp assembly 26 receive a shaft 53 that forms a depending extension of the cylinder 54 of the ram 34, and the apertures 52 in the ribs of the upper clamp assembly 28 receive a shaft 56 that forms an extension of the piston rod 55 of the ram 34. The lower end of the cylinder 54 has an outwardly directed flange 57 that is bolted by studs 58 to the end portion 51 of the upper rib 49, and another flange 60 that is appropriately secured to the piston rod 55 similarly is bolted by studs 61 to the end portion of the lower stiffener rib 50. Nuts 62 are threaded to the ends of the respective shafts 53 and 56 in order to secure the cylinder and the rod assemblies to the respective clamp assemblies 26 and 28.

The stiffener rib end portions 64 that are adjacent the hinge axis X—X are reduced in thickness and arranged in overlapping relationship with companion end portions 65 of stiffener ribs 66 that are welded to upper and lower outer surfaces of the semi-circular bowl 67 that comprises the hinged segment 37 of each of the clamp assemblies 26 and 28. Axially aligned holes 68 in the respective end portions 64 and 65 receive a shaft 70 that forms an extension of the cylinder 71 of the ram 35, whereas a like arrangement of rib end portions and holes receives a shaft 72 that forms an extension of the piston rod 73 of the ram. Hereagain the assembly is provided with flanges 74 and 75 that are bolted by studs 76 in a manner to rigidly attach the cylinder 71 to the lower clamp assembly 26 and the piston rod 73 to the upper clamp assembly 28, with nuts 77 being threaded on the lower end of the shaft 70 and a clevis 130 threaded onto the upper end of the shaft 72. The clevis has a hole 131 for attaching the alignment apparatus 25 to the adjusting cylinder 32 so that the apparatus may be suspended within the derrick as shown in FIG. 1.

Figure 8:
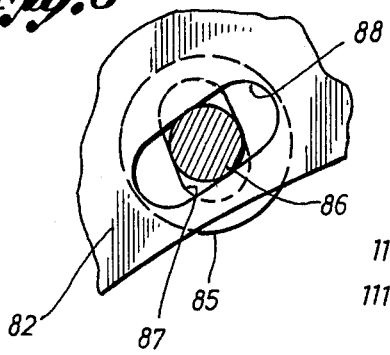
FIG. 8 is an enlarged fragmentary view of the scroll ring slot system that is used to enable inward and outward movement of the rollers and gripping devices of the respective clamp assemblies.
Figure 5:
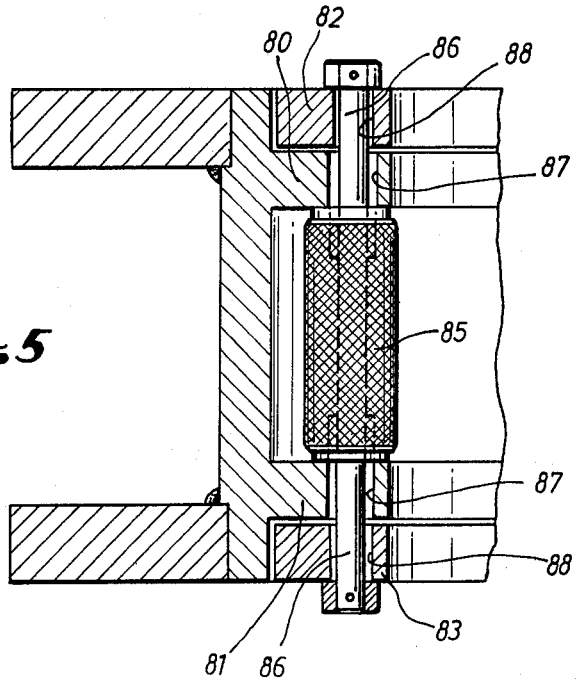
FIG. 5 is an enlarged sectional view of a roller means that may be used in the upper clamp assemblies.

The inner walls of the respective bowls 48 and 67 are each provided with upper and lower inwardly directed flanges 80 and 81 that provide cam tracks for semi-circular scroll rings 82 and 83 that are slidably mounted thereon. In a preferred embodiment, the upper clamp assembly 28 is provided with a plurality of circumferentially spaced cylindrical rollers 85, as shown in further detail in FIGS. 5 and 8, having axles 86 extending from the opposite ends thereof and passing through radially elongated holes 87 formed in the cam track flanges 80 and 81 as well as through elongated slots 88 in the scroll rings 82 and 83. The principal axis of each of the slots 88 is skewed somewhat and thus crosses the circle on which the rollers are arranged so that when viewed from above in FIG. 3, clockwise rotation of the scroll rings with respect to the cam track flanges 80 and 81 will force each roller 85 to move inwardly toward the center of the clamp assembly 28. Conversely, counterclockwise rotation of the scroll rings will cause the rollers to be shifted outwardly with respect to such center.

Spacer rods 90 are located between the various rollers 85, and extend through arcuate slots 91 in the upper and lower cam track flanges 80 and 81, with the ends of the rods being secured to the scroll rings 82 and 83 by nuts. An oppositely disposed pair of the spacer rods 90 are each connected to a return spring 93 that has one end attached by a bracket 94 to a respective bowl segment 67 or 48, whereby the scroll rings 82 and 83 are returned to the rotational positions shown in the drawings after having been rotated in a clockwise direction as will be described hereafter.

A drawbar arrangement that includes upper and lower plates 100 and 101 that are fixed to a spacer member 102 extend through a window 103 provided by cut out regions of the adjacent ends of the bowls 48 and 67. The ends of the member 102 are rigidly attached to the upper and lower scroll rings 82 and 83 by studs 107 or the like. The outer ends of the plates 100 and 101 are coupled to a take-up nut 104 by a kingpin 105. The nut 104, shown in enlarged detail in FIG. 6, has an elongated slot 106 therein that receives the kingpin 105 so as to enable a certain amount of play, and suitable means are provided to enable a limited amount of pivotal rotation of the nut about the axis of the kingpin while maintaining the general directional orientation of the nut shown in the drawing.

Figure 4:
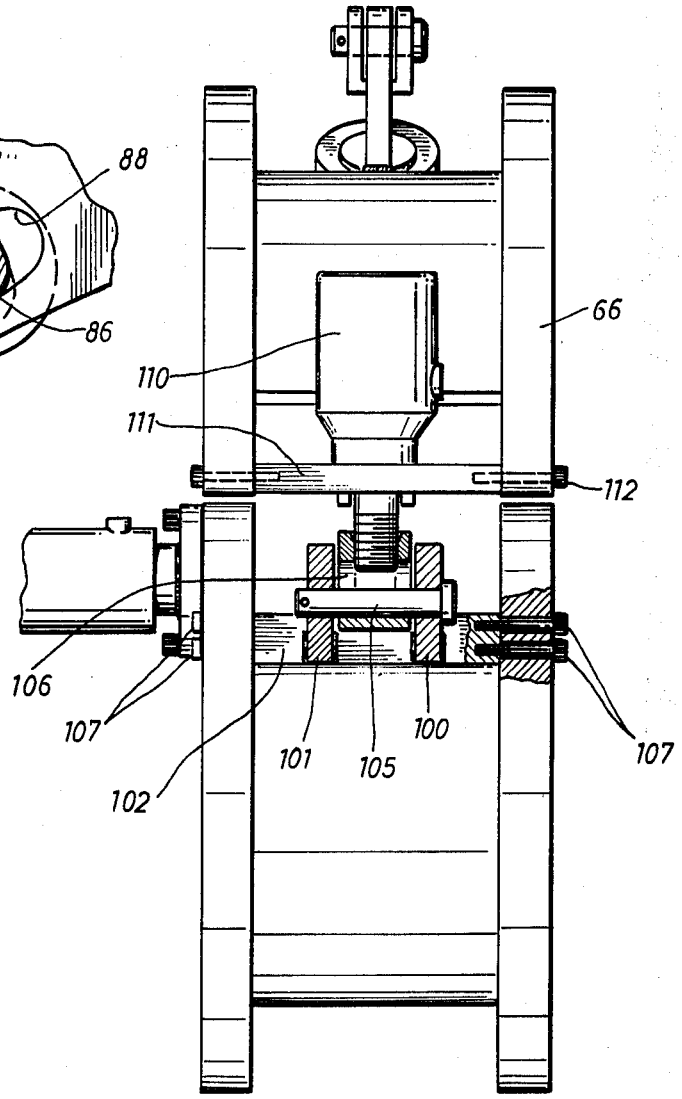
FIG. 4 is a side view of one of the clamp assemblies shown in FIG. 2.
Figure 6:
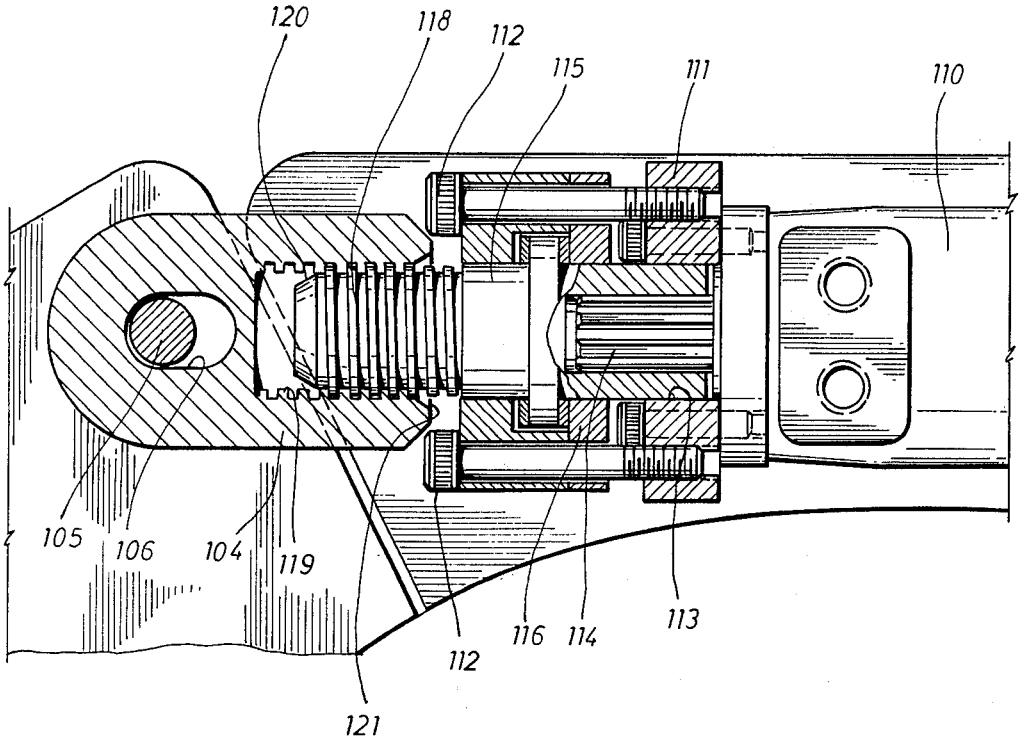
FIG. 6 is an enlarged cross-sectional to illustrate further detail of the closing motor and drawbar nut arrangement of each clamp assembly.

A reversible hydraulic motor 110 is mounted on the hinged segment 37 of each clamp assembly by a plate 111 that extends between the upper and lower stiffener ribs at the outer ends thereof and is fixed thereto by studs 112 (FIG. 4). As shown in FIG. 6, an opening 113 receives the output shaft 114 of the motor 110, and the shaft has a spline coupling to a drive member 115 that is journaled in a bearing 116 which is bolted to the plate 111 by studs 112. The drive member 115 has threads 118 that are adapted to mesh with the threads 119 of the drawbar nut 104. The threads 118 and 119 preferably are large acme-type threads, and chamfered surfaces 120 and 121 may be provided as guides. The motor 110 is mounted as shown in a proper orientation so that as the hinged segment 37 is closed toward the fixed segment 36, the threaded end of the drive member 115 automatically engages and aligns with the nut 104. Then operation of the motor 110 causes the nut 104 to be threaded onto the drive member 115 to thereby cause the drawbar to pull the scroll rings 82 and 83 and thus cause their rotation in the clockwise direction when viewed from above in FIG. 3. Such rotation forces the rollers 85 laterally inward as previously described so that the knurled outer surfaces thereof engage and frictionally grip the outer wall surfaces of a section of pipe extended therethrough. The hydraulic circuit that supplies fluid under pressure to the motor 110 includes components to enable the motor to stall when a predetermined tension is applied to the drawbar arrangement to thereby keep the inward forces applied by the rollers to the pipe within design limits.

It should be noted that although the scroll rings 82 and 83 are formed in semi-circular segments, when the jaws of the clamp assemblies are closed the segments provide an essentially continuous ring. Thus rotary movements thereof in order to shift the rollers inwardly or outwardly may be considered as if the segments form a solid or continuous ring.

Figure 7:
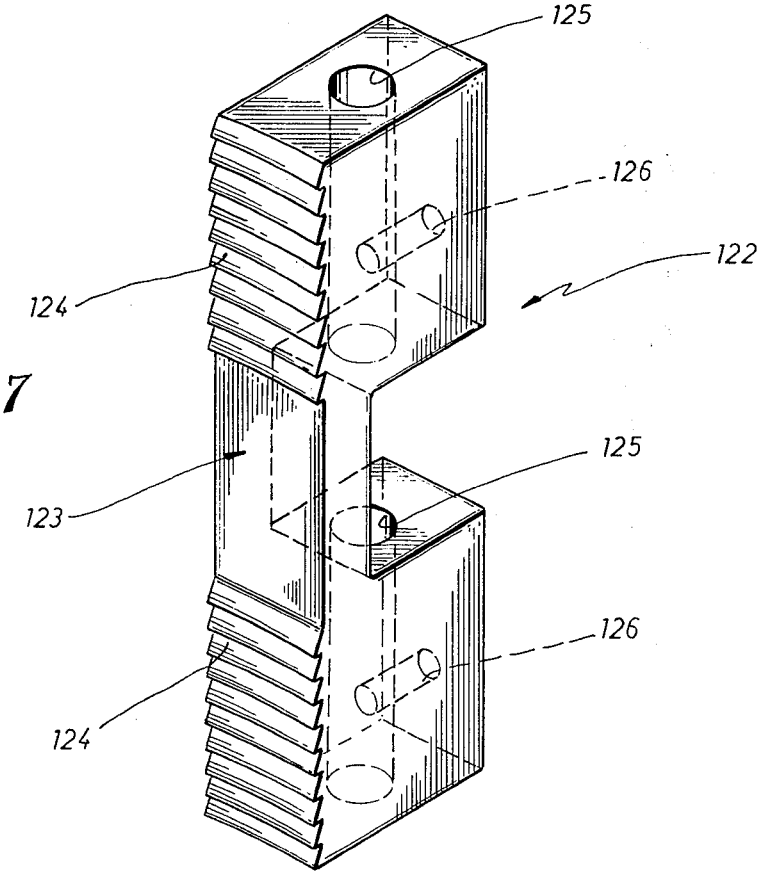
FIG. 7 is an enlarged isometric view of one of the plurality of gripping devices used in the lower clamp assembly.

The upper and lower clamp assemblies 26 and 28 are substantially identical except for the form of the gripping members 122 which are shown in enlarged detail in FIG. 7. The members 122 are generally rectangular slip blocks having slightly concave inner faces 123 provided with downwardly facing wickers or teeth 124 that are adapted to bite into the outer wall of the pipe joint 16 as the members are shifted inwardly into engagement therewith. Longitudinally extending bores 125 are adapted to receive the rods that have their ends extended through the slots in the cam track flanges and the scroll rings as previously described, and transverse bores 126 are provided and have threads (not shown) that receive locking pins which are employed to fix the slip blocks along the rods. The amount of concavity of the faces 123 is designed so that the faces fit snugly against the peripheral wall of the pipe, and thus are substantially self-aligning as the apparatus is operated.

The upper clamp assembly 28 can be provided with a hydraulic drive motor 125, as shown in FIG. 2, that is appropriately mounted by a bracket 126 to the upper stiffener rib 49 and coupled to at least one of the rollers 85 so as to power the same and cause rotation of the pipe joint that is being engaged by the entire set of rollers. A suitable coupling between the motor 125 and a roller 85 can take the form of sprocket 127 fixed to the upper end of the roller axle and driven by a chain 128 that passes around another sprocket 129 on the output shaft of the motor. Slack in the chain 128 will enable the driven roller 85' to be shifted inwardly and outwardly as previously described.

OPERATION

In operation, the pipe alignment tool 25, which is suspended in the derrick 11 by the line and the height adjusting cylinder 32, is moved over into alignment with the well bore axis. The hydraulic controls at the control console 45 are activated to open the hinged segments 37 of both clamp assemblies 26 and 28. The tool then is positioned such that the lower clamp assembly 26 is located below the collar 27 of the previously run pipe joint 16, whereupon the lower clamp assembly is closed around the pipe. The drive member 115 of the closing motor 110 automatically engages the nut 104 of the drawbar to cause the scroll rings 82 and 83 to rotate clockwise to bring the members 122 into forceful gripping engagement with the outer periphery of the pipe. Since these members 122 cannot rotate, the entire tool assembly is at this time rigidly fixed to the upper end portion of the pipe joint 16.

The upper pipe joint 10 which has been suspended from the elevators 12 then is approximately aligned with the axis of the well by the stabber, who works on the board 30, and the lower end of the pipe positioned within the jaw segments of the upper clamp assembly 28. Then the upper clamp assembly 28 is closed around the lower end portion thereof with the threaded pin end located somewhat above the collar 27 of the lower pipe joint 16. Hereagain the closing motor 110 of the upper clamp assembly 28 cooperates with the drawbar arrangement and scroll rings to cause the knurled rollers 85 to firmly grasp the pipe. With the rollers 85 engaging the end section of the pipe, it is contemplated that the elevators 12 of the rig can be lowered somewhat so that the entire weight of the pipe joint 10 is slacked off upon, and suspended by, the alignment tool. However, it will be recognized that full support is not necessary to the operation of the tool, and it may be preferable to suspend at least some of the pipe weight from the elevators 12. Either procedure will cause the pipe joint 10 to be precisely axially aligned with the lower pipe joint 16, whereupon the drive motor 125 may be activated to cause the pipe joint 10 to begin to rotate at a low rpm. Hydraulic fluid then is bled from the rams 34 and 35 below the respective pistons thereof to cause the rams to slowly close or retract, thereby lowering the rotating pin end of the joint 10 toward the stationary box end of the joint 16. As the pin enters the box the threaded connection is at least partially made up under power of the motor 125. Then the alignment tool 25 is released from the pipe joints by reversing the closing motors 110 to unthread the members 115 from the drawbar nuts 104 and actuating the cylinders 39 to open the clamp assemblies 26 and 28. Now the tool 25 can be moved away to the side so that conventional power tongs or the like can be used to fully tighten the joint to a specified make-up torque value.

The hydraulic circuits that are used to actuate the various cylinders and motors for the operator's console are constructed of well-known components and thus need not be described in detail herein.

Certain changes or modifications may be made in the disclosed embodiment by those skilled in the art without departing from the inventive concepts involved. For example, although two rams 34 and 35 are shown, a single ram could be used at the hinge axis X—X, together with suitable means such as a slidable spline connection to prevent relative rotation between the piston rod 73 and the cylinder 71. it also is within the scope of the present invention to use an axial cam means such as a jack with helical threads to adjust the vertical spacing of the clamp assemblies 26 and 28 instead of a hydraulic ram as disclosed. Other similar modifications undoubtedly will occur to those of ordinary skill in the art. Thus, it is the aim of the appended claims to cover all such changes and modifications falling within the true spriit and scope of the present invention.

What is claimed is:

1. Apparatus adapted for use in positioning the ends of pipe joints in axial alignment to facilitate the making of a threaded connection therebetween, comprising:

an upper clamp assembly and a lower clamp assembly, said lower clamp assembly being adapted to grasp the upper end portion of a pipe joint that extends downwardly into a well and said upper clamp assembly being adapted to grasp the adjacent lower end portion of a pipe joint that initially is suspended above said first-mentioned pipe joint, each of said clamp assemblies including a fixed segment and pivotal segment; means for hinging said fixed segment and said pivotal segment to one another, whereby said segments may be opened to permit said end sections to be positioned therein and then closed in order to grasp the same;

means for connecting said clamp assemblies in vertical alignment with one another to correspondingly align the said end portions of said pipe joints, said connecting means being operable to lower said upper clamp assembly toward said lower clamp assembly to bring the adjacent ends of said pipe joints into abutting engagement; and, further including first gripping elements mounted on said upper clamp assembly and second gripping elements mounted on said lower clamp assembly, said gripping elements being adapted to be brought into forceful engagement with outer peripheral wall surfaces of said pipe joints as said segments are closed, wherein said gripping elements are mounted for substantially radially directed inward and outward movement on said segments; and means for forcing said gripping elements radially inwardly against said pipe sections upon closure of said segments, and wherein said forcing means comprises cam means cooperable with said gripping elements, said cam means including ring segments rotatably mounted on each of said clamp assemblies, rotation of said ring segments in one rotational direction causing inward movement of said gripping elements and rotation of said ring segments in the opposite rotational direction causing outward movement of said gripping elements; and motor means for rotating said ring segments in said one rotational direction.

2. The apparatus of claim 1 further including means mounted on said upper clamp assembly for rotating said suspended pipe joint as the same is lowered toward said first-mentioned pipe joint.

3. The apparatus of claim 1 wherein said first gripping elements comprise roller means having knurled outer surfaces and said second gripping elements comprise slip means having toothed inwardly facing arcuate wall surfaces.

4. The apparatus of claim 3 wherein said rotating means includes drive means coupled to at least one of said first gripping elements.

5. The apparatus of claim 1 further including bias means for aiding in rotating said ring segments in said opposite rotational direction.

6. Apparatus for use in positioning the ends of pipe joints in axial alignment to facilitate the making of a threaded connection therebetween, comprising:

an upper clamp assembly and a lower clamp assembly, said lower clamp assembly being adapted to encircle and grasp the upper end portion of a pipe joint that extends into a well and said upper clamp assembly being adapted to encircle and grasp the adjacent lower end portion of a pipe joint that is being suspended above said first-mentioned pipe joint, each of said clamp assemblies including a fixed segment and a pivotal segment; means for hinging said pivotal segment to said fixed segment, whereby said segments may be opened to permit said end sections to be positioned therein and then closed in order to grasp the same;

selectively operable first hydraulic motor means for opening and closing said segments;

means for connecting said clamp assemblies in vertical alignment with one another to enable corresponding vertical alignment of said end portions of said pipe joints, said connecting means being operable to lower said upper clamp assembly toward said lower clamp assembly to bring the adjacent ends of said pipe joints into abutting engagement, said connecting means including selectively operable second hydraulic motor means; and further including first gripping means mounted on said upper clamp assembly and second gripping means mounted on said lower clamp assembly; means for shifting said gripping means inwardly and outwardly with respect to the longitudinal axis of said clamp assemblies to engage and release said gripping members with and from outer peripheral wall surfaces of said pipe joints; selectively operable third hydraulic motor means for operating said shifting means, wherein said shifting means comprises ring segments mounted on each of said clamp assemblies and being rotatable with respect thereto, said ring segments having cam means responsive to said rotation and engageable with said gripping means.

7. The apparatus of claim 6 wherein said third motor means is mounted on one of said clamp segments; and further including automatically engageable means for coupling said third motor means with said ring segments to cause rotation thereof in one rotational direction upon closure of said clamp segments.

8. The apparatus of claim 7 wherein said coupling means comprises drawbar means attached to said ring segments; and coengageable threaded members on said drawbar means and said third motor means.

9. The apparatus of claim 7 further including tension spring means for causing rotation of said ring segments in the opposite rotation direction upon release of said coupling means.

* * * * *